United States Patent [19]

Feneberg et al.

[11] 3,978,620

[45] Sept. 7, 1976

[54] APPARATUS FOR WORKING THE MARGINAL ZONES OF A LENS

[75] Inventors: Paul Feneberg; Planegg; Anton Schätz, Munich, both of Germany

[73] Assignee: AGFA-Gevaert, A.G., Leverkusen, Germany

[22] Filed: June 13, 1975

[21] Appl. No.: 587,233

Related U.S. Application Data

[62] Division of Ser. No. 474,429, May 29, 1974, Pat. No. 3,948,007.

[30] Foreign Application Priority Data

May 30, 1973 Germany ..... 2327583

[52] U.S. Cl. ..... 51/105 LG; 51/216 LP; 51/277

[51] Int. Cl.[2] ..... B24B 13/00; B24B 9/14

[58] Field of Search ... 51/105 LG, 106 LG, 216 LP, 51/235, 277, 284

[56] References Cited

UNITED STATES PATENTS

| | | | |
|---|---|---|---|
| 3,528,326 | 9/1970 | Kilmer | 51/235 X |
| 3,722,143 | 3/1973 | Cottom | 51/284 X |
| 3,750,272 | 8/1973 | Gomond | 51/284 X |
| 3,810,403 | 5/1974 | Ianuzzi | 51/284 X |

FOREIGN PATENTS OR APPLICATIONS

| | | | |
|---|---|---|---|
| 595,059 | 11/1947 | United Kingdom | 51/284 |

OTHER PUBLICATIONS

Heywood, Grinding Wheels and Their Uses, 1938, pp. 4 and 14.

*Primary Examiner*—Harold D. Whitehead
*Assistant Examiner*—Nicholas P. Godici
*Attorney, Agent, or Firm*—Michael J. Striker

[57] ABSTRACT

A lens of a soft and readily damaged material is placed onto a support having a surface whose contour corresponds to the mating contour of the juxtaposed surface of the lens. The support is rotated and the lens is shifted on it until the lens is centered on the surface of the support, whereupon suction is applied through the support to the lens to hold it immovable as the marginal zones of the lens are being worked.

11 Claims, 3 Drawing Figures

APPARATUS FOR WORKING THE MARGINAL ZONES OF A LENS

This is a division of application Ser. No. 474,429, filed May 29, 1974, now U.S. Pat. No. 3,948,007.

BACKGROUND OF THE INVENTION

The present invention relates to the working of lenses, and more particularly to the working of marginal zones of a lens.

In particular, the present invention relates to a method of working the marginal zones of a lens, particularly a contact lens, which is of soft and readily damaged material, and to an apparatus for carrying out the method.

There are lenses which are of relatively soft material that is therefore easily damaged, for instance by scratching or the like. The fact that these lenses are of soft material does not eliminate the need to properly work them, such as grinding them, polishing them and the like. However, the composition of the lens from such a material evidently imposes special problems in terms of handling the lens during the finishing or working operation to which it must be subjected. This is for instance true of contact lenses, which come either of relatively hard material or of relatively soft material, the latter being the type of material with which particular difficulties are being experienced.

It is known from German Pat. No. 2,102,820 to hold lenses of relatively soft material between two rotating spindles while their marginal zones are being ground or otherwise worked, and to direct a stream of a liquid cooling agent over the lens as well as the ends of the spindles which are adjacent to the same, in order to obtain a certain amount of rigidity of the marginal zones of the lens so that they can be worked without yielding excessively.

However, the actual application proposed in the aforementioned German patent is quite difficult and, therefore, time consuming and expensive. Moreover, the possibility is not reliably precluded that the lens might become damaged by scratching, due to relative movements of the lens and the supporting elements. In addition, the cooling of the lens— which is necessary in this prior-art proposal— brings with it the potential danger that the lens might break precisely because it is being so cooled.

SUMMARY OF THE INVENTION

It is a general object of the invention to overcome the disadvantages of the prior art.

More particularly, it is an object of the present invention to provide an improved method of working the marginal zones of a lens of relatively soft material, wherein these disadvantages are avoided.

Still more particularly, an object of the invention is to provide such an improved method in which any possibility of relative movements between the lens and the support therefor is avoided as the lens is being subjected to working of its marginal zones.

An additional object of the invention is to provide such a method wherein any necessity for cooling the lens and its support for purposes of working the marginal lens zones, is avoided.

Another object of the invention is to provide an apparatus for carrying out the novel method.

In keeping with the above objects, and with others which will become apparent hereafter, one feature of the invention resides in a method of working the marginal zones of a lens—particularly a contact lens—which is of soft and readily damaged material. The method comprises placing the lens onto a support, rotating the support, and effecting centering of the lens on the rotating support. Thereupon, the centered lens is removable retained on the rotating support by suction, and the marginal zones of the lens are then worked as required.

It is particularly advantageous if a viscous liquid, particularly an oil which is compatible with the material of the lens and it does not attack the material, is interposed between the lens and the support, in order to prevent a sliding of the lens off the support.

The centering of the lens is the result of engaging it so that the rotation of the support can effect a movement of the lens to centered position. Engaging of the lens can advantageously be carried out by means of a bifurcated member which is mounted for shifting movement transversely of the axis of rotation of the support. However, it is also possible to provide a hollow cap which is juxtaposed with the surface of the support onto which the lens is to be placed and which can be moved toward and away from this surface, being arranged so as to have the center of its open side which faces the support surface located on the axis of rotation of the support, and to be movable along this axis toward and away from the support.

It is advantageous if the support can be rotated at approximately 1000 rpm, although other rotational speeds could also be chosen.

The application of the suction is effected in a simple manner by forming the support surface onto which the lens is placed with openings, and by connecting these openings to a source of suction, advantageously to a vacuum pump of known construction.

The support itself should be readily exchangeable, so that different-sized supports can be exchanged one for the other in dependence upon the size of lens that is being worked.

The lens may have a curved (e.g., concave or convex) surface, and the support may have a support surface which is correspondingly curved, that is which is convex if the surface of the lens is concave, or vice versa. The peripheral marginal area of the surface on the support is advantageously flattened, in order to provide a beneficial positioning of the marginal zones of the lens with respect to the tool, such as an abrasive tool, which is used to work these marginal zones. The openings mentioned earlier are advantageously located at least in part in the transition area where the major portion of the support surface merges with the flattened peripheral area.

The tool used for working the marginal zones of the lens may be an abrasive tool which is essentially composed of fine-grained silicone carbonate which is bound together by an elastomeric binder material, for instance natural or synthetic rubber. Such a tool must be rotated at relatively high speeds in order to obtain the desired grinding effect on the marginal zones of the lens, and the construction which has just been mentioned assures that the tool may be rotated at such high speed—for instance at a peripheral speed on the order of 40 m/sec—without having to fear that the tool might become destroyed due to the high centrifugal forces which result.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
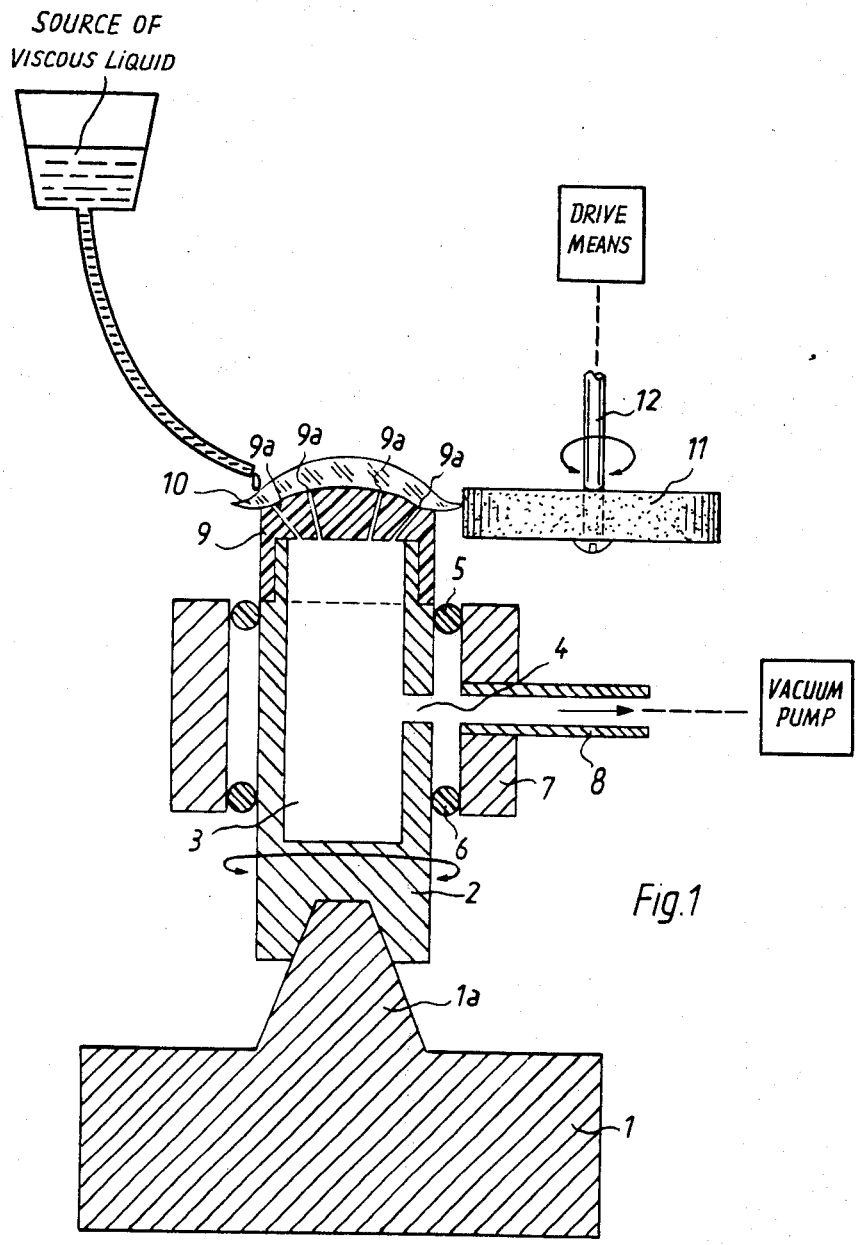
FIG. 1 is a sectional illustration of a first embodiment of the invention, with certain parts omitted for clarity.
Figure 2:
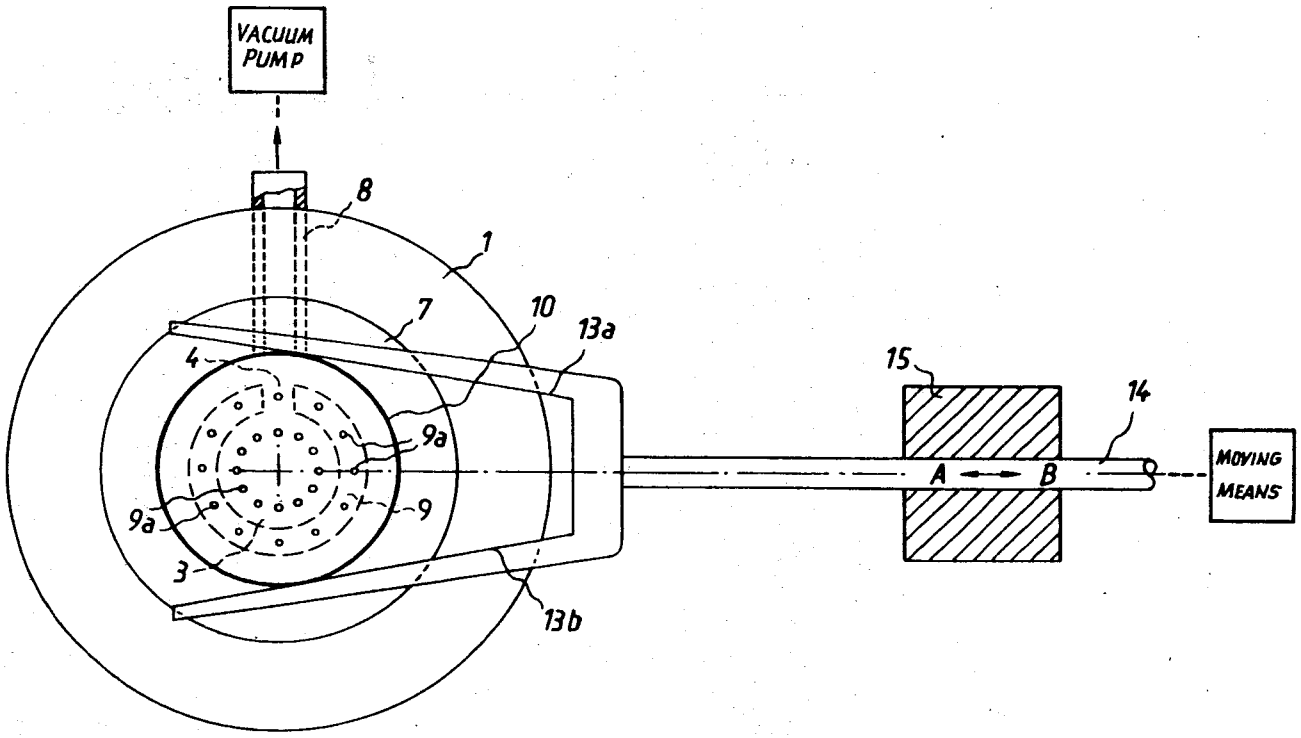
FIG. 2 is a top-plan view in somewhat diagrammatic illustration of the embodiment of FIG. 1, showing the parts which were omitted in that Figure but omitting, for clarity, some other parts which are shown in FIG. 1.

Referring firstly to the embodiment in FIGS. 1 and 2, it will be seen that reference numeral 1 identifies a rotatable member, for instance a spindle, which has a conical portion 1*a*. Supported on the conical portion 1*a*, by virtue of the fact that the latter extends into an appropriate recess, is a lens support 2 which turns with the member 1 when the latter is rotated, as is indicated by the circular arrow. The support 2 has a hollow interior space 3 which communicates with the exterior by way of a bore 4. At opposite sides of the bore 4, the support 2 is surrounded by a pair of O-rings 5 and 6, respectively, and the latter in turn are surrounded by an annular member 7, the dimensions of the O-rings 5, 6 and the member 7 being so selected that the O-rings are in sealing engagement with the inner surface of the member 7 and with the outer surface of the support 2. Thus, the interior space 3 of the support 2 is tightly sealed except with respect to the tubular portion 8 which is carried by the member 7 and by means of which the space 3 can be connected with the diagrammatically illustrated vacuum pump, which is of a construction that is known per se. The support 2 has a portion 9 which is provided with a lens supporting surface extending transversely to the axis of rotation of the support 2 and in this embodiment being curved to be matingly accommodated to the similarly curved contour of the lens 10, that is to the concave contour of the side of the lens 10 which faces the convex contour of the supporting surface on the portion 9. The latter portion is provided with a plurality of bores 9*a* which open in the lens supporting surface and communicate with the space 3.

* The member 7*c* does not rotate. The O-shaped rings 5 and 6 are lubricated with grease, so that they are prevented from being destroyed by friction.

The lens 10 has here been illustrated as a contact lens, that is a lens which is placed against the eyeball of a user to eliminate the necessity for spectacles. However, it could of course be a lens for other purposes. What is important is that the lens 10 will be of a relatively soft material that can be readily damaged unless it receives special handling. Such materials are, for instance, disclosed in U.S. application Ser. No. 85,703 to Mast et al. They are also disclosed in the aforementioned German patent No. 2,102,820. The particular composition of the material is of no importance in the context of the present invention, as long as it is understood that the material is soft, by comparison to the much harder material that is used for other types of similar lenses and which does not pose the special problems posed by the softer material, either in terms of the damage possibility or in terms of having to make appropriate provision for the marginal zones of the lens not to yield excessively when subjected to a working operation.

A working tool is here identified with reference numeral 11, being configurated as a grinding wheel which has a shaft 12 that can be driven in rotation by the diagrammatically illustrated drive means, as indicated by the circular arrow associated with the shaft. As mentioned earlier, the grinding wheel 11 is advantageously of small-grain silicone carbonate, the particles of which are bound by an elastomeric binder, such as natural or synthetic rubber. The grinding wheel 11 may be rotated at various speeds, and it has been found that if it is rotated at a peripheral speed of approximately 5 m/sec the marginal zones of a lens 10 can be shaped in the desired manner within an economically acceptable time period. However, with the present invention it is possible to rotate the grinding wheel 11 at much higher peripheral speeds, for instance on the order of 40 m/sec, without thereby causing any damage to the marginal zones of the lens 10, and of course thereby obtaining a much more rapid shaping of the marginal zone. The grinding wheel 11 may be appropriately profiled if it is desired to give the marginal zone a particular configuration which can be obtained by such profiling. The upper limit of the peripheral speed at which the grinding wheel 11 can be rotated is dictated not by the possibility that the lens 10 might be damaged by engagement with the grinding wheel when the same rotates at such high speeds, but by the fact that at speeds which are substantially in excess of 40 m/sec the centrifugal forces acting upon the (not entirely balanced) grinding wheel 11 will become so great as to destroy it.

When the apparatus of FIGS. 1 and 2 is to be utilized, a viscous liquid, such as an oil of a type which will be compatible with the material of the lens 10 and will not attack this material or other liquids with those properties, such as water, alcohol, silicone-oil, glycerol or mixtures of those liquids, is applied between the surface of the portion 9 and the lens 10, whereupon the latter is placed onto this surface. Now, the spindle 1 and thereby the support 2 are rotated, and of course this rotation is transmitted to the lens 10. Advantageously, the speed at which the support 2 is rotated will be on the order of approximately 1000 rpm. If the liquid between the portion 9 of the support 2 and the lens 10 has the appropriate viscosity, no slippage will occur between the lens 10 and the portion 9 during this rotation. At this time, however, the lens 10 will not yet be properly centered with respect to the portion 9.

To obtain such centering, a bifurcated member having arms 13*a* and 13*b* is provided which—as shown in FIG. 2—is mounted in a supporting member 15 through a bore of which a rod 14 of the bifurcated member extends. This rod 14 is shiftable in the directions of the double-headed arrow A-B, and for this purpose is connected with a diagrammatically illustrated moving means known per se, so that it can be either shifted towards or away from the lens 10.

Once the lens 10 rotates with the support 2 but is not yet centered on the portion 9 thereof, the bifurcated member is moved in the direction of the arrow A in FIG. 2, until its arms 13*a*, 13*b* carefully contact the margin of the lens 10 and displace the latter just sufficiently for it to assume a centered position on the surface of the portion 9. Thereupon, the rod 14 is again operated to retract the bifurcated member in the direction of the arrow B away from the lens 10. The diagrammatically illustrated vacuum pump 1 of FIG. 1 is now operated, or else a connection is established between it and the conduit portion 8, so that suction is exerted via the space 3 and the bores 9*a* upon the underside of the lens 10, thereby holding the latter firmly in its centered position on the portion 9. The grinding operation can now begin, and it will be understood that either the grinding wheel 11, the support 2, or both, may be made movable relative to one another so that there is no contact of the lens 10 with the grinding wheel 11 until the lens has been properly centered and is retained by suction.

Figure 3:
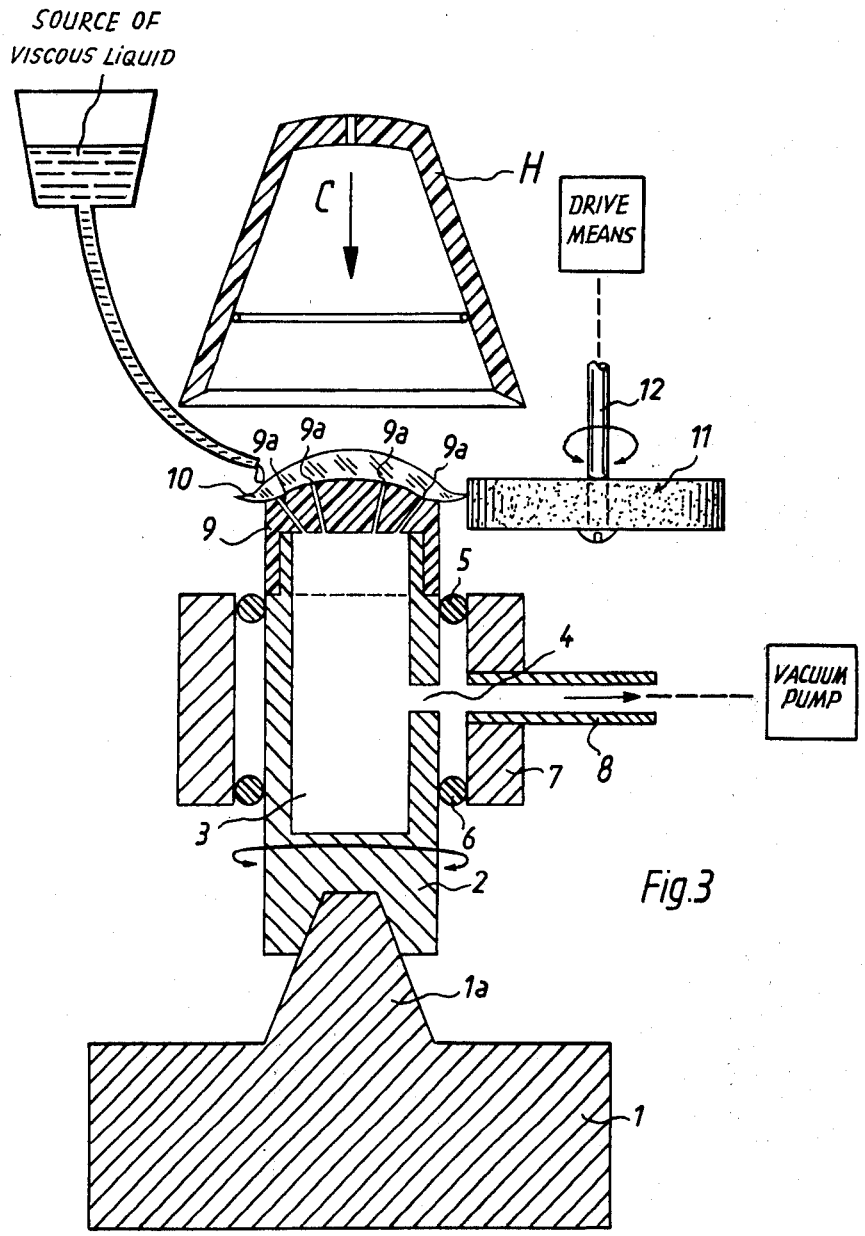
FIG. 3 is a view similar to FIG. 1, but illustrating a further embodiment of the invention.

The embodiment of FIG. 3 is analogous to that of FIG. 1, and like reference numerals have been used to identify like elements. The only difference in the embodiment of FIG. 3 over that of FIG. 1 is that the bifurcated member 13*a*, 13*b*, 14 and its supporting member 15 have been omitted, and that the centering of the lens 10 on the portion 9 of the support 2 is carried out by means of a cap H which is mounted upwardly of the portion 9 and can move toward and away from it, as indicated by the double-headed arrow C. The hollow interior of the cap H, the open side of which faces the portion 9 and extends normal to the axis of rotation of the support 2, is conical as illustrated. The cap H is, of course, centered on the axis of rotation of the support 2, and may be connected with similar moving means as illustrated in FIG. 2 for the rod 14. The operation of the cap H is essentially the same as that of the bifurcated member in FIG. 2, in that when the lens 10 is in place but has not yet been centered as it rotates with the support 2, the cap H is gently lowered until it engages the marginal zone of the lens 10 and shifts the same to a centered position, whereupon the cap H is raised again and suction is applied to hold the lens 10 in position. The viscous fluid may in both embodiments be sprayed, dripped or otherwise applied to the exposed lens-supporting surface of the portion 9, as diagrammatically illustrated by the nozzle shown in FIG. 1, or it may be applied separately to that side of the lens 10 which is to face the lens-supporting surface.

Once the lens 10 is firmly held by vacuum in either of the two embodiments, its marginal zone which extends outwardly beyond the portion 9 can be worked—i.e., operated and shaped by the tool 11—since it is now firmly held and cannot yield excessively even though the material of the lens 10 is soft. Moreover, proper positioning of the marginal zones is further assured and facilitated by the fact that the circumferential edge zone bounding the lens-supporting surface of the portion 9 is somewhat flattened as compared to the remainder of this surface.

It will be understood that each of the elements described above, or two or more together, may also find a useful application in other types of constructions differing from the type described above.

While the invention has been illustrated and described as embodied in an arrangement for working the marginal zones of a soft material lens, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various modifications without omitting features that, from the standpoint of prior art, fairly constitute essential characteristics of the generic or specific aspects of this invention.

We claim:

1. An apparatus for working marginal zones of a lens — particularly a contact lens — which is of soft and readily damaged material and has a curved side bounded by a circumferential marginal portion, comprising a rotatable support having a surface on which the lens is to be placed and which extends transversely through the axis of rotation of said support, said surface having a center portion curved matingly relative to said curved side of said lens and a flattened peripheral portion surrounding said main portion along a junction area therewith; centering means for centering the lens on said surface; means for applying in said junction area suction to said lens so as to draw said marginal portion thereof into contact with said peripheral portion to thereby temporarily flatten and position it for proper working; and working means for working said marginal portion of the lens centered on said surface.

2. An apparatus as defined in claim 1, wherein said working means comprises an abrasive element.

3. An apparatus as defined in claim 1, wherein said centering means comprises a hollow cap which is juxtaposed and coaxial with said surface and movable lengthwise of said axis of said rotation into and out of engagement with said lens.

4. An apparatus as defined in claim 1, wherein said side is concave and said surface is matingly convex.

5. An apparatus as defined in claim 1, wherein said suction means comprises openings through which suction can be applied to said lens.

6. An apparatus as defined in claim 3, wherein said hollow cap has a substantially conically configurated hollow interior and an open side facing said surface.

7. An apparatus as defined in claim 1, wherein said working means comprises an abrasive element which is substantially composed of fine-grained silica carbonate and an elastomeric binder for the same.

8. An apparatus as defined in claim 7, wherein said binder is rubber.

9. An apparatus as defined in claim 7, wherein said abrasive element is mounted for rotation relative to said support.

10. An apparatus as defined in claim 7, wherein said abrasive element is mounted for rotation relative to said support at peripheral speeds on the order of 40 m/sec.

11. An apparatus for working marginal zones of a lens — particularly a contact lens — which is of soft and readily damaged material, comprising a rotatable support having a surface on which the lens is to be placed and which extends transversely through the axis of rotation of said support; centering means for centering the lens on said surface, comprising a bifurcated lens engaging member which is mounted for shifting movement transversely of said axis of rotation and working means for working said marginal zones of the lens centered on said surface.

* * * * *